United States Patent [19]

Harper

[11] Patent Number: 4,587,753

[45] Date of Patent: May 13, 1986

[54] HOUSE SIGNALING DEVICE

[76] Inventor: Douglas M. Harper, 3746 Conroy Trail, Inver Grove Heights, Minn. 55075

[21] Appl. No.: 590,508

[22] Filed: Mar. 16, 1984

[51] Int. Cl.[4] ..... G09F 3/04

[52] U.S. Cl. ..... 40/451; 40/450; 40/579; 40/580; 340/715; 340/756; 340/331

[58] Field of Search ..... 40/580, 579, 450, 451; 340/715, 756, 331, 791, 628

[56] References Cited

U.S. PATENT DOCUMENTS

| | | | |
|---|---|---|---|
| 1,786,155 | 12/1930 | Farrell | 40/580 |
| 2,068,827 | 1/1937 | Tompkins | 40/579 |
| 3,207,948 | 9/1965 | Beguin | 250/214 AL |
| 4,024,532 | 5/1977 | Sherwin | 40/450 |
| 4,164,824 | 8/1979 | Nidelkoff | 40/450 |

FOREIGN PATENT DOCUMENTS

| | | | |
|---|---|---|---|
| 156621 | 10/1932 | Switzerland | 40/579 |
| 392608 | 5/1933 | United Kingdom | 40/580 |

*Primary Examiner*—Gene Mancene
*Assistant Examiner*—Wenceslao J. Contreras
*Attorney, Agent, or Firm*—Schroeder & Siegfried

[57] ABSTRACT

A mechanism is disclosed that is secured in a frame for holding the indicia forming material and is used to cover a housing that includes a light source which may be controlled through a photoelectric cell. The sheets making up the indicia are formed in such a manner that the characters are all created in a stylized "8" digital format with a centrally located "1" superimposed down the middle of the "8". The "8" characters with the "1" superimposed are diestampted in a separate sheet so that it alone may be changed to change the indicia to be displayed.

The circuit is designed to produce a flashing light under normal conditions to attract an observer. When an emergency is created such as detected by a smoke detector, a red light flasher is seen giving an additional warning at the front of a house.

4 Claims, 4 Drawing Figures

HOUSE SIGNALING DEVICE

DESCRIPTION

BACKGROUND OF PRIOR ART

This invention relates to a numeric display device and more particularly to a display device having a changable indicia.

It has been found that there are numerous devices which are available for displaying different forms of indicia to indicate price, quantity and location such as a residence address. Most of the devices displaying such a numeral are formed so that the entire numerical display must be rearranged when the number is selected or is to be changed. For instance, U.S. Pat. No. 4,387,522 makes use of a series of interlocking rectangular plates which may be secured together by changing all of the plates to create a new house number.

In a somewhat similar manner, U.S. Pat. No. 3,631,474 is formed in which certain squares, rectangles, triangles, diamonds, circles and the like are used to form symbols which may be punched from a plastic frame to form a number or letter. It is necessary to use a cutting tool to punch the different segments from the lattice work.

Another U.S. patent, U.S. Pat. No. 4,216,599 makes use of a form of film strip that may be used with certain structures which form a light box.

These and other similar structures make no provision for readily changing a resident house number or for readily forming a particular number to be associated with that particular residence. The present invention makes use of a structure that renders the invention in its most readily usable form and avoids certain of the problems associated with the patents just described.

BRIEF SUMMARY OF THE INVENTION

It is therefore a general object of the present invention to provide an improved indicia mechanism generally used with a private house residence number.

It is a more specific object of this invention to provide an indicia character sign or box that may be secured to a private home and have the indicia designated with a minimum amount of overall correction that is needed.

It is still another object of my invention to provide a sheet that may be diecut with a stylized "8" having a centrally located "1" superimposed therein.

It is yet another object of this invention to have the sheet formed of a thin plastic material that may be releasably secured to another sheet having indicia formed therein.

It is still another object of the invention to have the illumination of the indicia controlled through the use of a photoelectric cell, which may be seen during daylight hours without illumination.

It is thus another object of this invention to use a dual control to identify different functions of the indicia.

It is still another object of this invention to provide an indicia character sign having a circuit that may be used with a smoke detector and or a gas detector to signal an observer on the outside of a house.

It is yet a more specific object of the invention to provide an indicia character sign having a circuit that may be used with a thermostat to signal an observer upon the temperature reaching a predetermined value.

Preferably, the apparatus of the invention makes use of a stylized series of numbers which are formed in a side-by-side arrangement such that when the person acquiring such a device desires, he may form any series of numbers that he wishes to designate his house residence.

BRIEF DESCRIPTION OF THE DRAWING

A detailed description of one preferred embodiment of the house signaling device is hereafter described with specific reference being made to the drawings in which.

DETAILED DESCRIPTION OF INVENTION

Figure 1:
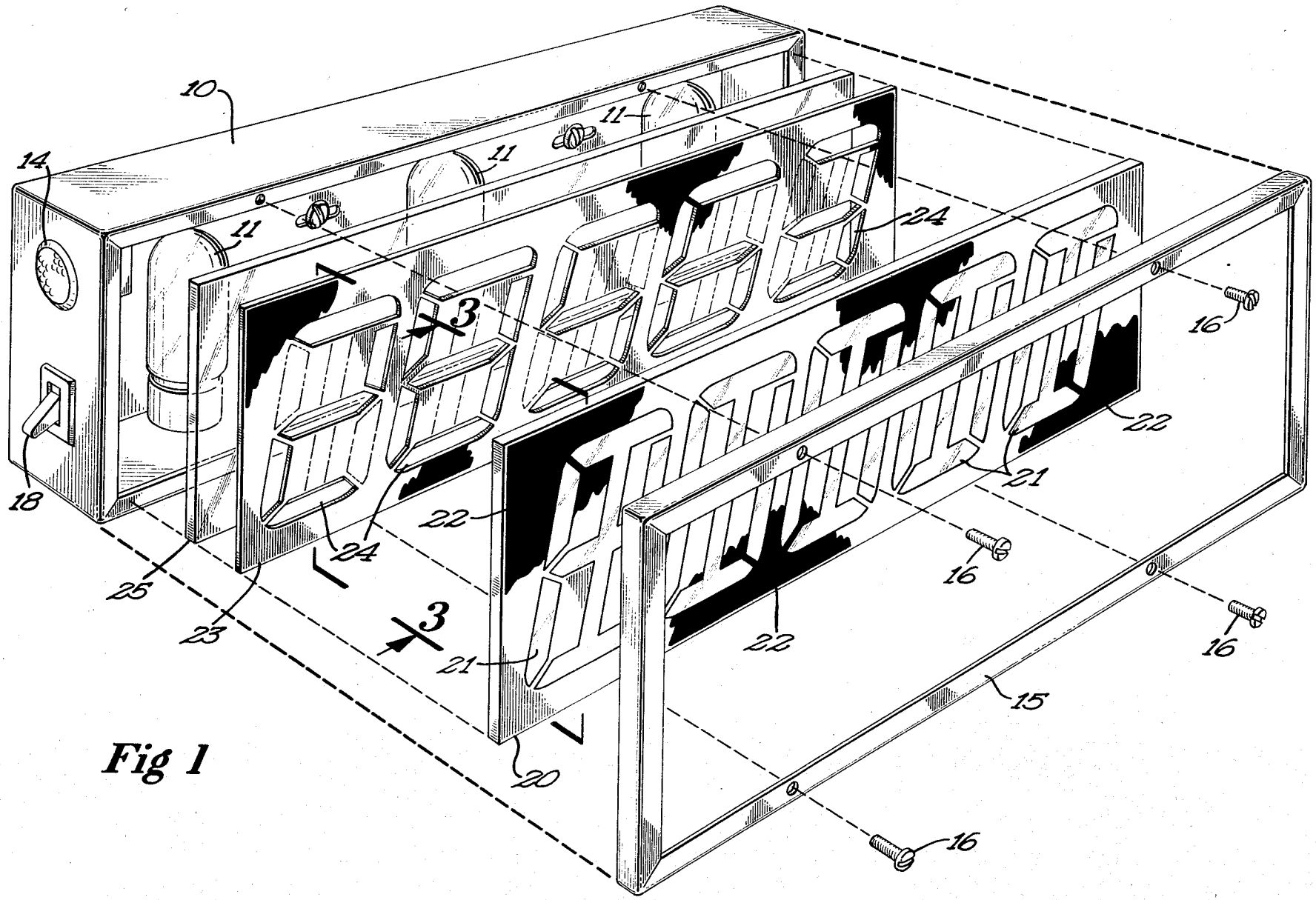
FIG. 1 is an exploded view of the invention showing general location of all of the component parts.
Figure 2:
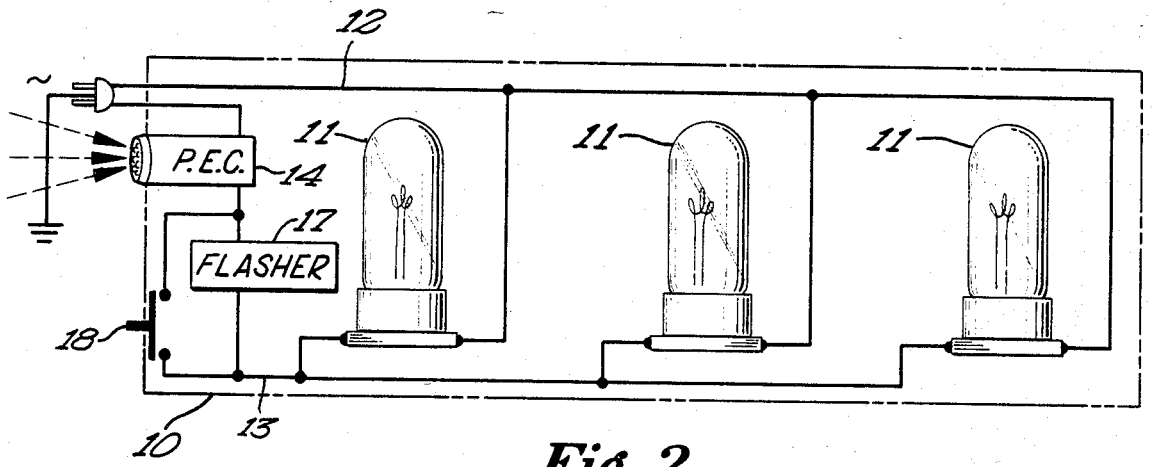
FIG. 2 is an electrical diagram of the invention.
Figure 3:
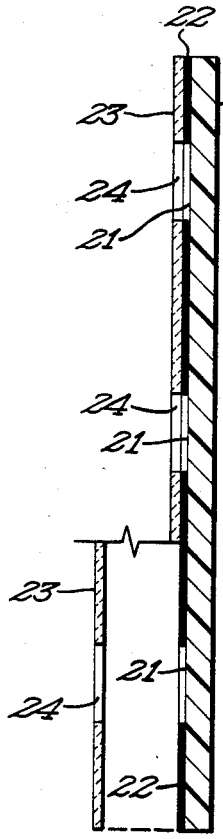
FIG. 3 is a cross-section of a portion of the invention as taken along lines 3—3 as found in FIG. 1.

Turning now to FIG. 1, there is disclosed a housing 10 that is in the nature of a sheet metal box that may be formed of 20 gauge metal and painted an appropriate color to be secured to the side of a house by appropriate means such as screws. The housing 10 is rectangular in nature and is deep enough to carry a plurality of electrical lamps 11 that are connected in parallel to an electrical circuit created by wires 12 and 13 (shown principally in FIG. 2). Also shown connected in line 13 is a photoelectric cell 14 that may be adjusted to receive sunlight and form an appropriate electrical switch when the sunlight reaches a certain level. In other words, the photoelectric cell 14 may be adjusted for an appropriate level of sunlight at which lamps 11 will be caused to receive electrical energy. A lamp flasher 17 is also connected in series with photoelectric cell 14 and a switch 18 is connected in parallel with the flasher 17. The switch is located outside housing 10 and maybe controlled by the homeowner.

A frame or bezel 15 is formed to fit over the front of housing 10 and is secured to housing 10 through the use of a plurality of fastners such as screws 16. The housing may be approximately 18 inches in length, 4¾ inches in heighth and approximately 1½ inches in depth.

Disposed at the front of the frame is a plastic sheet 20 approximately 18 by 4¾ inches formed from Lexan® approximately 0.060 inches thick which is used to the indicia sheet. Disposed across the sheet, are five typical characters or digits 21 that are in the shape of the numeral "8" with a "1" superimposed down the center of the character. Each of the characters is approximately 2.5 inches in width and approximately 4 inches in heighth. The sheet is covered with a typical black paint or screen 22 so that each of the characters is illuminated, particularly when exposed to light from lamps 11.

Another sheet 23 is disposed immediately behind sheet 20 and has the same typical arrangement of characters 21 as found in sheet 20. Sheet 23 may be formed from 10 mill thick cardboard with the characters diestamped or perforated so that the different numbe. may be formed to coincide with the light emitting portions of characters 21 in sheet 20. Thus, when a typical number is diestamped or formed in sheet 23, it may be removed prior to insertion in frame 15 to form the proper character or indicia. Each character or number is aligned with characters 21 so that a full compliment of numbers may be found in the display. However, sheet 20 also may be clear, and the diecut on sheet 23 will still display the proper number.

When the outside light dimishes to turn on photoelectric cell 14, a translucent sheet of material 25 disposed behind sheet 23 is used to properly disperse the light to emerge through the characters 21 and 24. For certain installations, sheet 25 may be omitted.

In some installations, instead of using the 10 mill thick cardboard digit selector, a thin application of plastic material may be applied directly to the Elexion sheet 20 and diestamped so that the characters may be formed by lifting the diecast segments.

For some installations, switch 18 may be opened, placing flasher 17 in the circuit when it is desirable to identify the residence for guests or someone who may be looking for that particular resident number.

Figure 4:
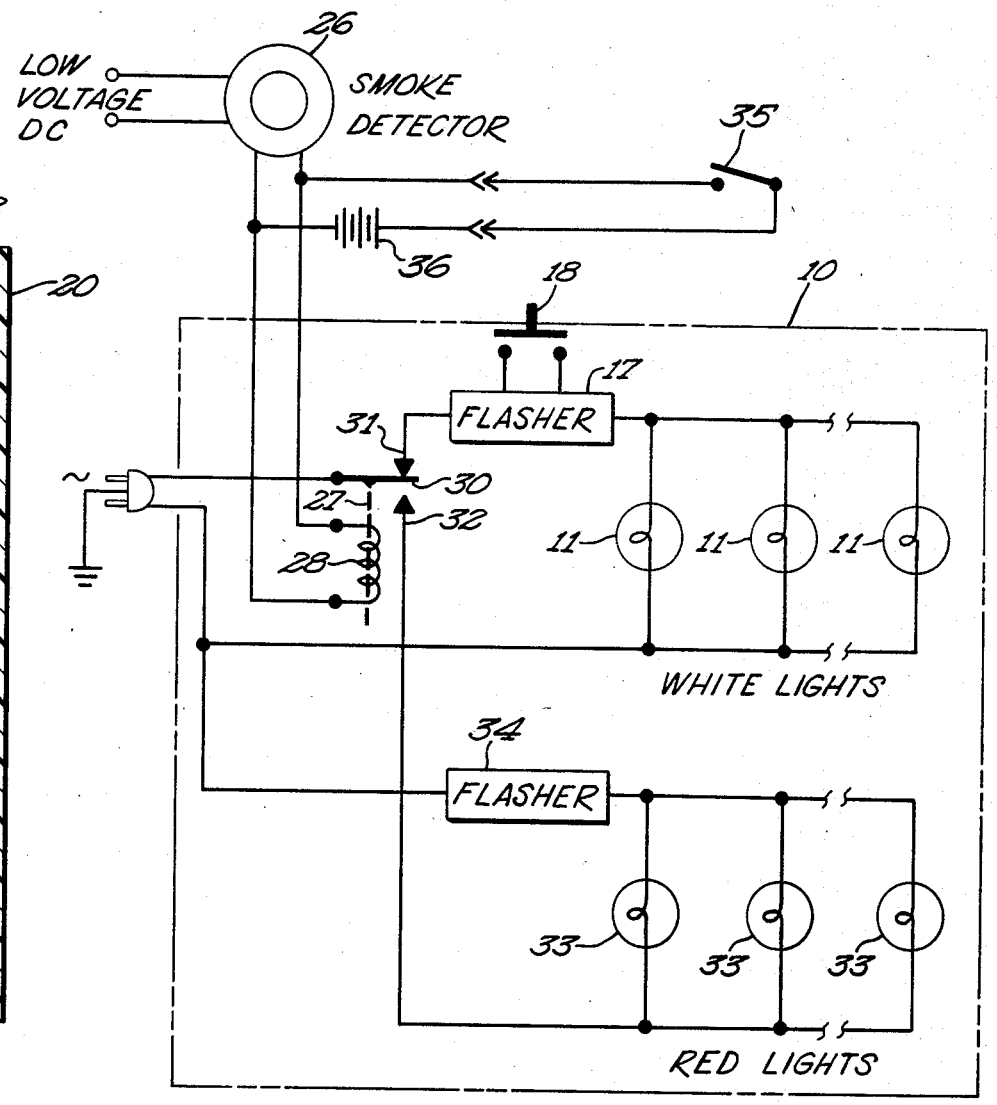
FIG. 4 is a circuit used with a smoke detector.

The indicia with lamps 11 may be connected in such a manner as to act as an alarm signaling device such as found in FIG. 4. In that circuit, a smoke detector 26 is connected to a low voltage direct current source and has a relay 27 that has its coil 28 connected to the output mechanism of the smoke detector such as an oral alarm or horn. When coil 28 is energized, the relay armature 30 is pulled from a normally closed contact 31 to engage a normally open contact 32. Contact 31 is connected to a flasher unit 17 which is controlled through siwtch 18 so that lamps 11 may be actuated in a flashing manner or in a steady state manner. Armature 30 is connected to a plug having the other common terminal of lamps 11 connected thereto, and which is electrically excited by an alternating current.

Should the smoke detector be actuated, upon detection of smoke or gas within the building, armature 30 engages contact 32 that actuates a second group of lamps 33 which may be colored to disclose an alarm system that is in operation. It has been found that a color such as red is preferable to show an alarm. The alarm lamps 33 may be enhanced through the use of a flasher 34 which is like flasher 17 and is connected to the plug having an alternating current applied thereto. The flasher may be of a form such as found in U.S. Pat. No. 3,382,405 which produces a blinking effect but does not permit the lamps to extinguish before becoming excited again.

There may also be occasions in which it is desirable to have a remote switch 35 connected in series with a battery 36, the combination being in parallel with coil 28 to be controlled from a distance by someone who may be ill or incapacitated. Flashing lamps 33 in a signal color can alert observers that a problem exists inside the house.

In considering this invention, it should be remembered that the present discloseure is illustrative only and the scope of the invention should be determined by the appended claims.

What is claimed is:

1. An observable multiple character incidia forming assembly, the improvement comprising:

(a) a first sheet of light transmitting material having a plurality of indicia forming characters of a number "8" including a centrally located "1" arranged therein, said indicia formed in a side-by-side arrangement;

(b) a second sheet of light blocking material having opaque qualities with the same indicia forming characters as found in said first sheet, but disposed so that they may be superimposed one on the other, said characters having been die cut along the contours of each segment forming said indicia to facilitate removal of said light blocking material from said second sheet at predetermined locations;

(c) a frame member engaging each of said first and second sheets of material along their edges and holding all of said sheets to display the indicia formed by said sheets;

(d) a light containing housing secured to said frame and extending rearwardly from said frame;

(e) a light source causing light to be projected forwardly through said first and second sheets where there is an absence of opaque material; and (f) a photoelectric cell connected in said light source interrupting said light projected when sunlight is equivalent to a predetermined value set in said photoelectric cell;

(g) a flasher secured in series with said photoelectric cell; and (h) a switch connected in parallel with said flasher to electrically insert said flasher in the circuit when desired.

2. The invention set forth in claim 1 including:

(i) a source of power;

(j) relay means having a plurality of electrical contacts connected to said source of power and said light source, said relay means having a coil to be energized for switching between said plurality of electrical contacts;

(k) a sensor connected to said source of power for detecting an atmospheric condition;

(l) a second light source connected to said plurality of electrical contacts, said second light source fering from said first enumerated light source in at least one observable characteristic.

3. The invention set forth in claim 2 wherein said relay means includes a smoke or gas detector connected to said coil for changing light sources.

4. The invention set forth in claim 3 wherein said second light source differs from said first source in at least color.

* * * * *